US008425821B2

(12) United States Patent
Vedula et al.

(10) Patent No.: US 8,425,821 B2
(45) Date of Patent: Apr. 23, 2013

(54) METHOD OF MELT SPINNING AN ELASTOMERIC FIBER

(75) Inventors: Ravi R. Vedula, North Ridgeville, OH (US); James E. Bryson, Jr., Cuyahoga Falls, OH (US)

(73) Assignee: Lubrizol Advanced Materials, Inc., Cleveland, OH (US)

( * ) Notice: Subject to any disclaimer, the term of this patent is extended or adjusted under 35 U.S.C. 154(b) by 320 days.

(21) Appl. No.: 12/884,321

(22) Filed: Sep. 17, 2010

(65) Prior Publication Data

US 2012/0001362 A1 Jan. 5, 2012

Related U.S. Application Data

(62) Division of application No. 11/613,209, filed on Dec. 20, 2006, now abandoned.

(60) Provisional application No. 60/753,139, filed on Dec. 22, 2005.

(51) Int. Cl.
*D01D 5/38* (2006.01)
*D01D 4/06* (2006.01)

(52) U.S. Cl.
USPC ..... 264/177.16; 425/198; 425/376.1; 425/461

(58) Field of Classification Search ..... 264/172.17, 264/177.16; 425/191, 192 S, 197, 198, 199, 425/376.1, 382.2, 461, 464
See application file for complete search history.

(56) References Cited

U.S. PATENT DOCUMENTS

| | | | | |
|---|---|---|---|---|
| 2,408,713 | A | 10/1946 | Webb | |
| 2,971,219 | A | 2/1961 | Hill | |
| 3,500,499 | A | 3/1970 | Goossens | |
| 4,072,457 | A | 2/1978 | Cooksey et al. | |
| 4,077,880 | A | 3/1978 | Lorenz et al. | |
| 4,104,015 | A | 8/1978 | Meyer | |
| 4,131,731 | A | 12/1978 | Lai et al. | |
| 4,494,921 | A | 1/1985 | Sowell | |
| 4,887,957 | A | 12/1989 | Ohta et al. | |
| 5,795,595 | A | 8/1998 | Beeck et al. | |
| 6,709,147 | B1 | 3/2004 | Rauwendaal | |
| 2004/0230012 | A1 * | 11/2004 | Vedula et al. | 525/453 |

FOREIGN PATENT DOCUMENTS

| | | | |
|---|---|---|---|
| GB | 983638 | A | 2/1965 |
| JP | 2006-312242 | A | 11/2006 |
| WO | 2005/005697 | A1 | 1/2005 |

* cited by examiner

*Primary Examiner* — Yogendra Gupta
*Assistant Examiner* — Joseph Leyson
(74) *Attorney, Agent, or Firm* — Christopher D. Hilker

(57) ABSTRACT

A spin pack assembly for use in melt spinning elastic fibers. The spin pack assembly includes a circular breaker plate having a center aperture and several circular patterns of apertures with each circular pattern having a plurality of apertures. Each circular pattern is located concentrically about an axis of the center aperture. The apertures in the outer circular patterns have a greater diameter than the apertures in the inner circular patterns. The spin pack assembly also has a spinneret plate where the exit aperture of the spinneret plate is recessed in the body of the spin pack assembly.

19 Claims, 6 Drawing Sheets

METHOD OF MELT SPINNING AN ELASTOMERIC FIBER

CROSS REFERENCE TO RELATED APPLICATION

This is a divisional application of U.S. Ser. No. 11/613,209 filed on Dec. 20, 2006 which is now abandoned. This divisional application claims benefit pursuant to 35 U.S.C. 119(e) of provisional application No. 60/753,139 filed on Dec. 22, 2005, as did U.S. Ser. No. 11/613,209.

FIELD OF THE INVENTION

The present invention relates to devices and methods for use in melt spinning of elastomeric fibers, such as polyurethane fibers. Exemplary embodiments relate to a spin pack assembly used to produce such fibers.

BACKGROUND OF THE INVENTION

The vast majority of thermoplastic polyurethane (TPU) fibers are made by a dry spinning process involving dissolving the TPU in a solvent. Melt spinning TPU fibers has been gaining in use in recent years. Melt spinning does not involve the use of a solvent, and therefore is more environmentally friendly.

Melt spinning TPU fibers involves feeding TPU polymer into an extruder and from the extruder to a spinneret where the fiber exits the spinneret. Polymers, such as TPU, tend to crystallize or crosslink so as to form lumps if they remain in melt processing equipment for too long. This is especially the case where crosslinking agents are added to the TPU prior to being fed to the spinneret. These early formed crystallized polymer and/or crosslinked polymer lumps may find their way through the spinneret and cause defects or undesirable properties in the fiber. Fiber breakage can also result. Lumps of crystallized and/or crosslinked material may also accumulate in the cavities upstream of the fiber opening. This can result in excessive back pressure and reduced material flow. Back pressure can build up to the point where fiber can no longer be produced. This requires shutting down the process of manufacturing the fiber and cleaning the equipment to remove the blocking material.

Another problem that can occur with melt spinning TPU fibers is that the modulus of the fibers can be too high for circular knitting applications.

Thus, there exists a need for improvements in melt spinning of elastomeric fibers.

SUMMARY OF THE INVENTION

It is an object of an exemplary embodiment to melt spin elastic fibers, such as TPU, in a process that gives long run times.

It is another object of an exemplary embodiment to make a melt spun TPU fiber with lower modulus, as measured at 100% elongation.

It is another object of an exemplary embodiment to provide a spin pack assembly that produces a fiber with more desirable properties, provides faster running rates, and achieves longer run times.

Further objects of exemplary embodiments will be made apparent in the detailed description herein and the appended claims.

These objects are accomplished in an exemplary embodiment by using a spin pack assembly to produce a fiber. The spin pack assembly includes a breaker plate comprising a circular metal plate with a plurality of apertures of different size diameters. The aperture in the center of the breaker plate is the smallest hole and the apertures are progressively larger the farther they are from the center of the breaker plate. The apertures the greatest distance from the center have the largest diameter. This configuration of the holes in the breaker plate provides for first-in/first-out flow of material throughout generally the entire cavity within the spin pack assembly. The flow in the exemplary embodiment provides for increased flow in areas radially disposed from a central axis of the spin pack assembly. In the exemplary embodiment this approach generally avoids material being resident within the spin pack assembly for a time that is less than a reaction time after which numerous lumps of cross linked and/or crystallized material form within the assembly. The approach of the exemplary embodiment provides desirable flow properties that produce fewer defects in the fiber. In addition, the exemplary structure of the spin pack assembly provides lower back pressure buildup through longer running times which reduces process downtime and increases productivity.

In the exemplary embodiment of the spin pack assembly, the spin pack assembly has a generally cylindrical body with a body opening. The fiber is produced by passing the material through a fiber opening in a spinneret plate. The fiber is produced at an exit. The exit is disposed axially inward relative to the body opening. This structure in the exemplary embodiment allows the fibers to cool more slowly relative to prior designs. This results in lower modulus fiber and enables faster running rates.

DETAILED DESCRIPTION OF THE INVENTION

Figure 1:
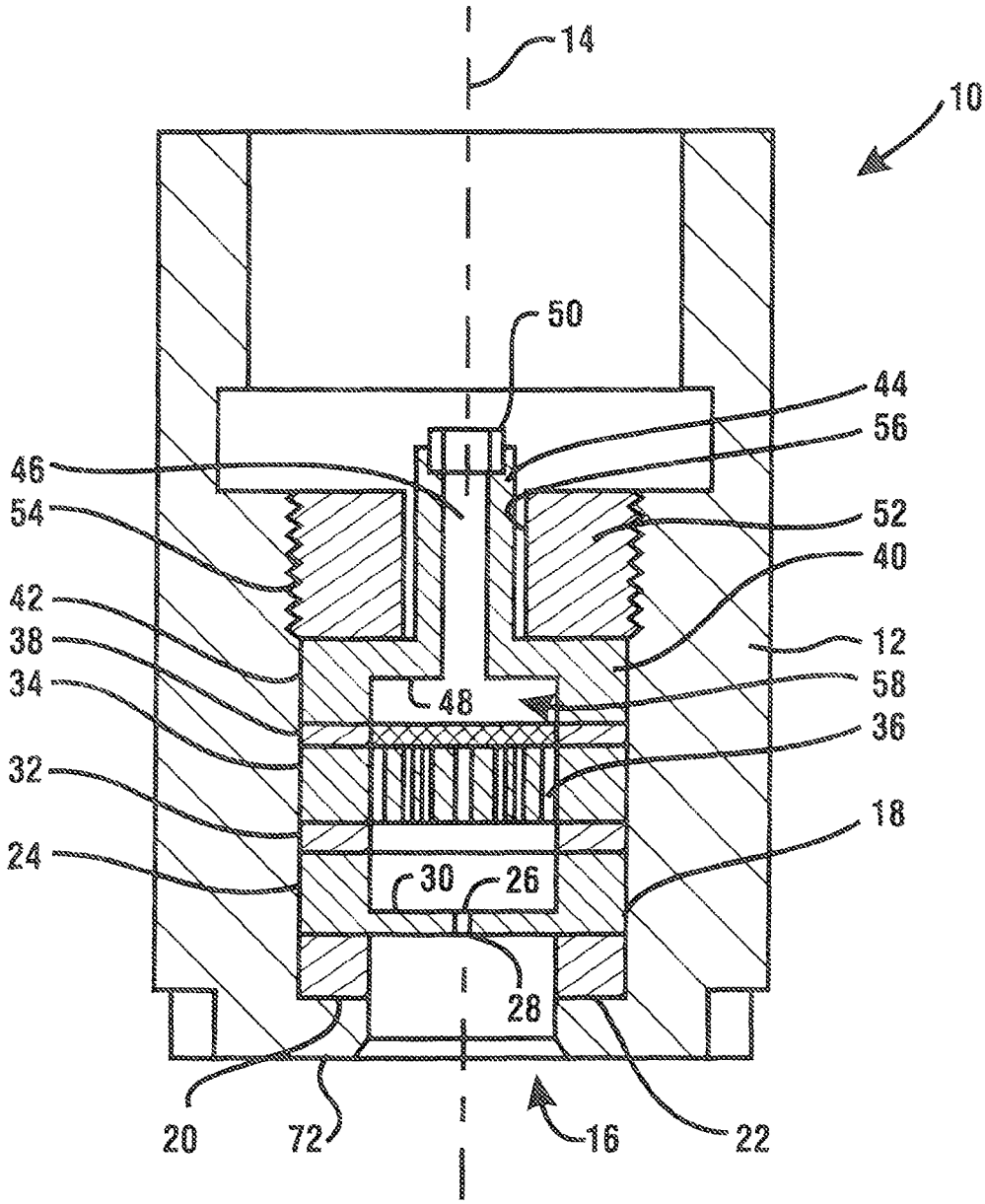
FIG. 1 is a cross-sectional view of an exemplary spin pack assembly including a breaker plate and a recessed spinneret plate fiber exit opening.

Referring now to the drawings and particularly to FIG. 1 there is shown therein a spin pack assembly (10) of an exemplary embodiment. The spin pack assembly 10 includes a generally cylindrical body 12. Body 12 extends along a central axis 14.

In the exemplary embodiment the body includes the body opening 16 at an axial end thereof. Body opening 16 is of a smaller diameter than a bore 18 which extends within the body. In the assembled position of the spin pack assembly the bore includes a number of stacked components. These components in the exemplary embodiment include an annular spacer 20. In the exemplary embodiment spacer 20 is supported on an inward extending annular step 22 that bounds the bore.

A spinneret plate 24 is positioned adjacent to spacer 20. Spinneret plate 24 includes an axially positioned fiber opening 26 therein. Opening 26 produces a single fiber from the exemplary spin pack assembly in a manner later discussed. The single fiber is produced at an exit 28 from the fiber opening. The exit is disposed axially inward of the body opening in the exemplary embodiment. The exemplary spinneret plate 24 further includes a recess area therein which is bounded by a generally planar annular surface 30. Planar annular surface 30 generally extends in surrounding relation of the fiber opening 26.

An annular washer 32 is positioned in the assembly adjacent to the spinneret plate 24. The annular washer 32 of the exemplary embodiment includes a central opening that corresponds in diameter to the recess in the spinneret plate.

The exemplary assembly further includes a breaker plate 34. The breaker plate 34 of the exemplary embodiment includes a plurality of apertures 36 therethrough. As later discussed in detail the arrangement of apertures of the exemplary embodiment provides material flow properties through the spin pack assembly that provides desirable properties in producing the fiber.

Figure 8:
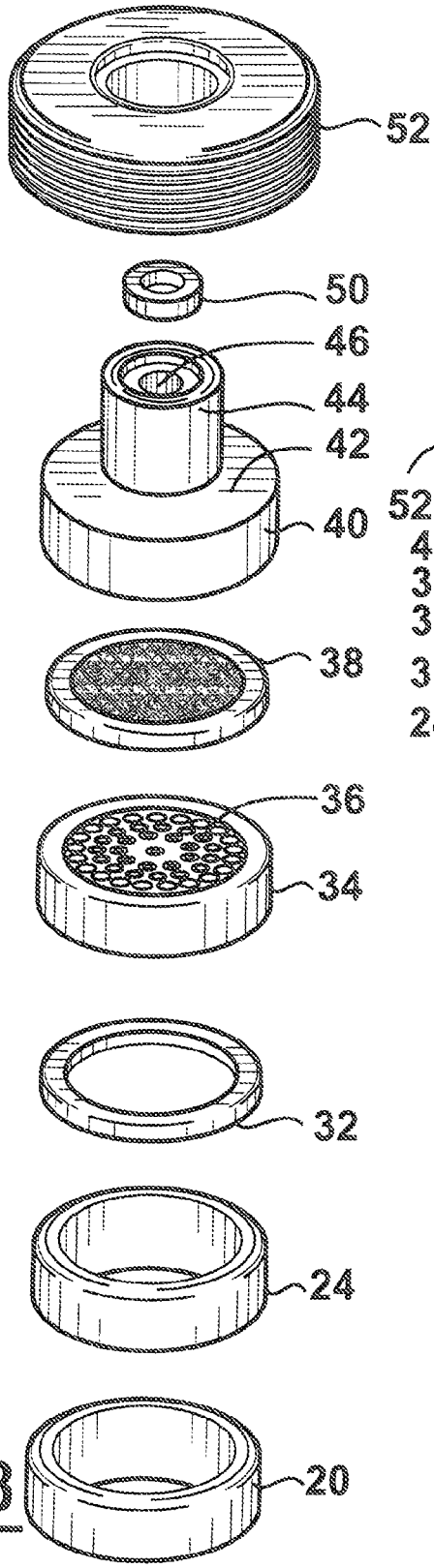
FIG. 8 is an exploded view of the components in the exemplary spin pack assembly within the body.

Adjacent to the breaker plate 34 of the exemplary embodiment is a screen 38. As best shown in FIG. 8 the screen of the exemplary embodiment includes a central porous area and a peripheral annular solid area. Of course it should be understood that this structure is exemplary and in other embodiments other approaches may be used.

The exemplary assembly further includes a transport channel piece 40. The transport channel piece of the exemplary embodiment includes an annular portion 42 and a cylindrical projection portion 44. An inlet 46 operative to receive fluid material extends axially through the transport channel piece. In the exemplary embodiment the transport channel piece includes a generally planar annular surface 48. In the exemplar embodiment the generally planar annular surface extends in surrounding relation of the inlet 46. The exemplary transport channel piece 40 also includes on the cylindrical projection portion, a recess in which a compression washer 50 is positioned. Compression washer 50 facilitates fluid tight connection with a conduit that supplies the fluid material which forms the fiber.

The exemplary spin pack assembly further includes a compression nut 52. Compression nut 52 of the exemplary embodiment includes an external annular threaded portion 54. Threaded portion 54 is configured to engage mating threads positioned in a corresponding portion of the bore 18. Compression nut 52 further includes an access opening 56 which is axially centered therein. The cylindrical projecting portion of the transport channel piece of the exemplary embodiment extends through the access opening in the assembled condition of the spin pack assembly. It should be further understood that the compression nut 52 may include apertures or other suitable structures that facilitate rotation of the compression nut so as to hold the components of the spin pack assembly in assembled stacked relation in the bore during use and for also enabling the disassembly of the components as may be desirable for replacement, cleaning or other purposes. Of course it should be understood that these structures are exemplary and in other embodiments other approaches may be used.

Figure 9:
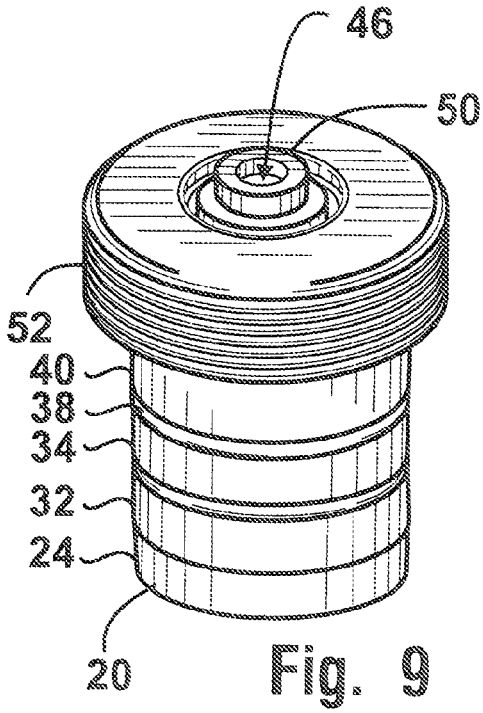
FIG. 9 is an isometric view of the components shown in FIG. 8 in an assembled condition.

As is apparent from FIGS. 8 and 9, in the exemplary embodiment of the assembly, the spacer, spinneret plate, washer, breaker plate, screen and transport channel piece may be assembled in the bore 18. The assembled components are held in place therein by tightening the compression nut 52. Further, when the components are assembled the spin pack assembly includes a cavity area generally indicated 58, through which the material flows between the inlet 46 and the exit 28. In addition as can be appreciated, the components of the spin pack assembly may be removed for repair, replacement or cleaning by loosening the compression nut 52 and removing the various components from the bore. It should be further understood that these components are exemplary and the principles described herein may be used with other components in spin pack assemblies or other assemblies which are adapted for producing fibers of thermoplastic materials.

Figure 2:
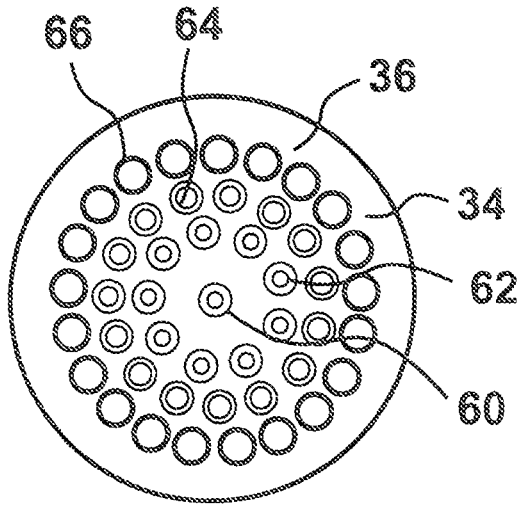
FIG. 2 is a top view of an exemplary breaker plate used in the assembly of FIG. 1.

FIG. 2 shows a top view of the exemplary breaker plate 34. As discussed, the exemplary breaker plate 34 includes a plurality of apertures 36. In the exemplary embodiment the apertures include an axially aligned central aperture 60. Central aperture 60 in the assembled position of the spin pack assembly is aligned with the axis 14. The exemplary breaker plate 34 further includes apertures arranged in three concentric circular patterns about the central aperture 60. Apertures 62 are included in the first concentric circular pattern. Apertures 64 are included in the second concentric circular pattern and are disposed radially outward relative to the apertures 62 in the first concentric circular pattern. Apertures 66 in the third concentric circular pattern are disposed radially outward of the apertures 64 in the second concentric circular pattern. Of course it should be understood while in the exemplary embodiment three concentric circular patterns are used, in other embodiments other approaches may be used.

In exemplary embodiments the apertures 62 in the first concentric circular pattern are of a smaller effective diameter for purposes of material flow and have a smaller cross-sectional area than the apertures 64 in the second concentric circular pattern. Likewise, in the exemplary embodiment the apertures 66 in the third concentric circular pattern have a greater diameter and cross-sectional area than the apertures 64 in the second concentric circular pattern.

Further, in the exemplary embodiment the radial distance from the central aperture 60 to the apertures 62 in the first concentric circular pattern, is a greater radial distance than the radial distance between the apertures 62 and the apertures 64, and is also a greater radial distance than between the apertures 64 and the apertures 66. This configuration in the exemplary embodiment provides flow properties which have proven desirable for purposes of producing fibers of the exemplary embodiment.

During operation of the exemplary embodiment the plurality of apertures provide a greater material flow with increasing radial distance from the axis 14. This approach provides for a desirable flow pattern within the cavity area 58. The aperture arrangement provides a first-in/first-out flow generally throughout the entire cavity area. This flow which can alternatively be referred to as plug flow, assures that generally the polymer melt in the cavity area is not resident during operation for the reaction time that would otherwise result in the production of crosslinked and/or crystalline material which forms semi-solid lumps in the polymer melt. For purposes of this disclosure the term "lumps" should be understood to include solid and semi-solid bodies which have a consistency less fluid than the other material flowing through the cavity area. As previously discussed, such lumps are undesirable, and may cause defects and undesirable properties in the fiber which is produced. Such lumps within the cavity area can also produce increased back pressure which impedes the flow of material through the spin pack assembly to produce the fiber. Such reduced flow results in slower running speeds and eventually stoppage of the production process so that the spin pack assembly can be cleaned.

Figure 3:
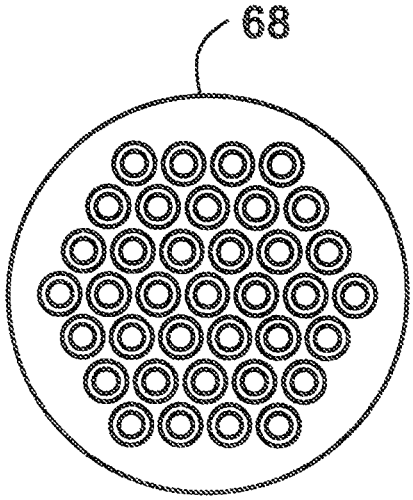
Fig. 3 (Prior art)
FIG. 3 is a top view of an exemplary prior art breaker plate.

The principles employed in connection with the exemplary breaker plate 34 can be further appreciated from the pattern of apertures shown in the prior art breaker plate 68 shown in FIG. 3. The prior art breaker plate 68 includes a uniform pattern of apertures. This uniform pattern generally results in most material passing through the central apertures and through the opening the spinneret plate to produce the fiber. Material passing through other apertures moves more slowly and thus more material remains within the spin pack assembly for a period of time that reaches the reaction time. As a result, lumps form within the cavity area. These lumps operate to restrict flow which results in increased back pressure and slower operating speeds. The formation of such lumps also impacts the quality of the fiber material produced at the spinneret opening. These undesirable aspects are reduced by applying the principles described herein.

Although in an exemplary embodiment the arrangement of concentric circular patterns of apertures is used to achieve desirable flow properties, in other embodiments other approaches may be used. These may include for example, breaker plates which include arcuate patterns of apertures to achieve desirable characteristics. These arcuate patterns may include elongated slots or spirals that achieve flow characteristics that produce the desirable results as described. In other embodiments spiral arrangements of apertures including apertures of various shapes may be used. In still other embodiments structures other than breaker plates may be employed so as to achieve the desired flow properties. These flow properties can be achieved through the use of apertures, vanes, weirs or other structures. Of course these approaches are exemplary and in other embodiments other approaches may be used.

A further useful aspect of the exemplary spin pack assembly is the shape associated with the cavity area 58. In the exemplary embodiment the cavity area is axially bounded by the generally annular surfaces 48 and 30. These generally annular surfaces provide advantages in the nature of maximizing flow rates and minimizing surface area.

Figure 4:
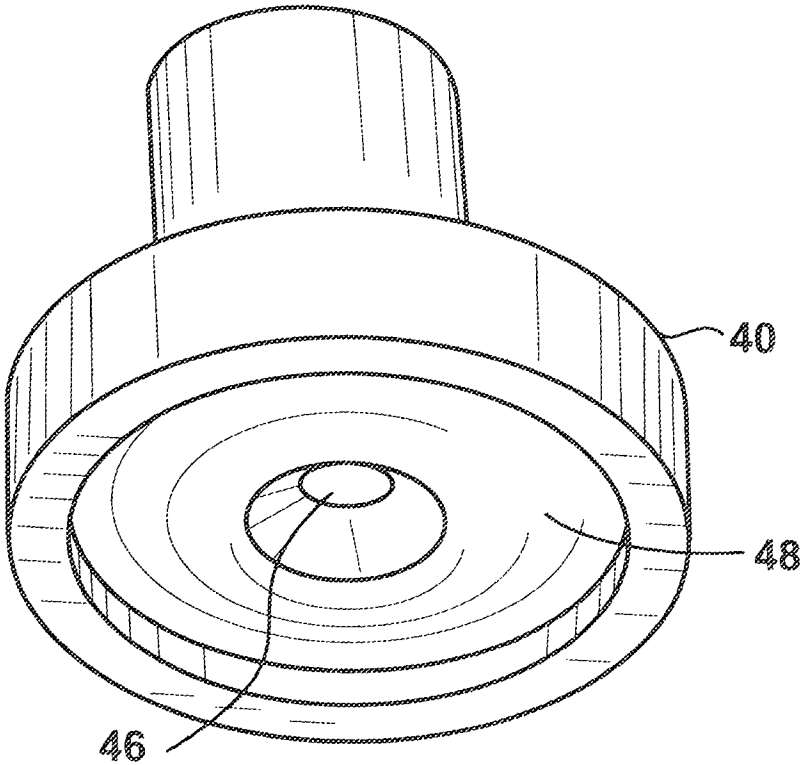
FIG. 4 is an isometric view of an exemplary transport channel piece of the exemplary assembly of FIG. 1.
Figure 5:
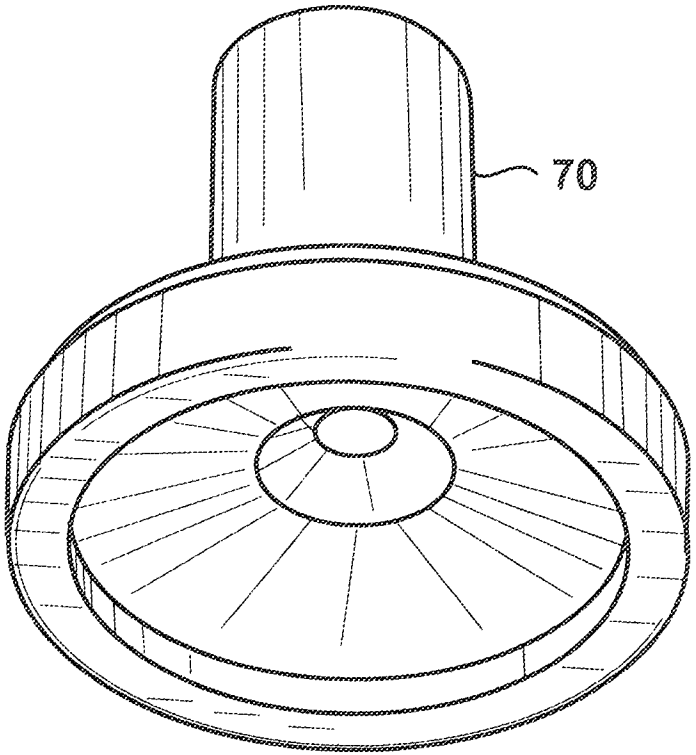
Fig. 5 (Prior art)
FIG. 5 is an isometric view of an exemplary prior art transport channel piece.

FIG. 4 shows the transport channel piece 40 of the exemplary embodiment. The planar surface 48 surrounds the material inlet and during operation forces material to flow radially outwardly as the material enters the recessed area therein at elevated pressure. This structure helps to move the material through the transport channel piece generally more quickly compared to the prior art structure 70 which is shown in FIG. 5. As can be appreciated the prior transport channel piece 70 includes a more conical chamber. The conical chamber increases the area and potential material residence time within the cavity. The structure of the exemplary piece 40 is intended to minimize those conditions which may result in undesirable lumps within the material. Similar principles apply to the configuration of the planar annular surface 30 which surrounds the fiber opening in the spinneret plate 34. Of course these approaches are exemplary and in other embodiments other approaches may be used.

A further useful aspect of the exemplary embodiment of the spin pack assembly is the configuration of the fiber exit from the spinneret plate relative to the body opening. In the exemplary embodiment the exit 28 of the axially positioned fiber opening 26 is axially disposed inwardly relative to the flat annular surface 72 in which the body opening 16 extends. In the exemplary embodiment the fiber exit 28 is disposed axially inwardly more than 5 millimeters (mm) in the body annular surface. Further in the exemplary embodiment used in the production of TPU fiber, the exit is recessed 15.5 mm relative to the body annular surface. In alternative embodiments greater recesses may be used. This recessed configuration allows the fiber to cool more slowly. This results because during the critical period after the fiber first exits the opening in the spinneret plate, the fiber remains surrounded by the hot body of the spin pack assembly. Further, as the fiber passes out the exit it is surrounded within the recess by relatively stagnant hot air that further facilitates slower cooling. This slowness to cool in the exemplary embodiment results in a fiber having a lower modulus at 100% elongation. This lower modulus is especially desirable when the fiber is to be used in circular knitting processes such as to make fabric.

Figure 6:
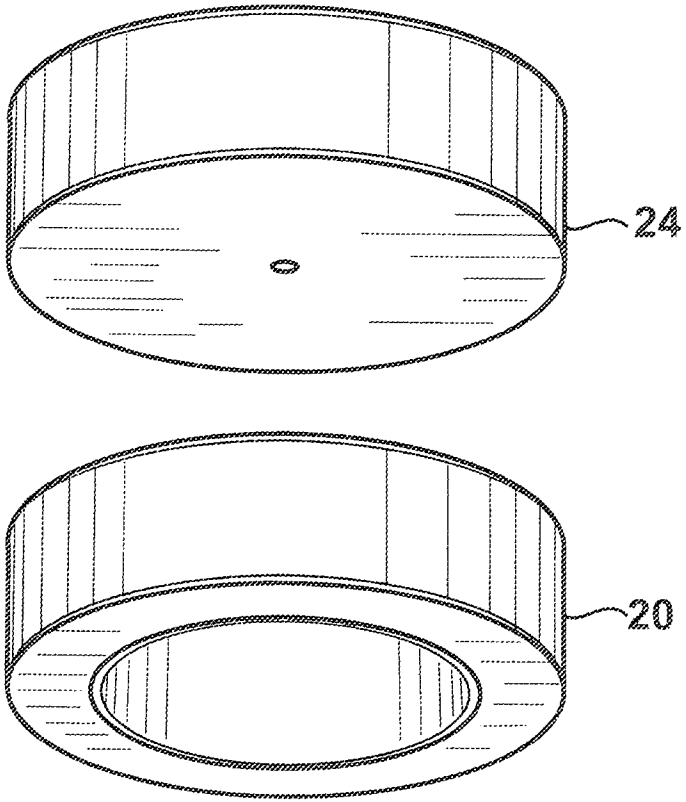
FIG. 6 is an isometric view of a spacer and spinneret plate of an exemplary embodiment.
Figure 7:
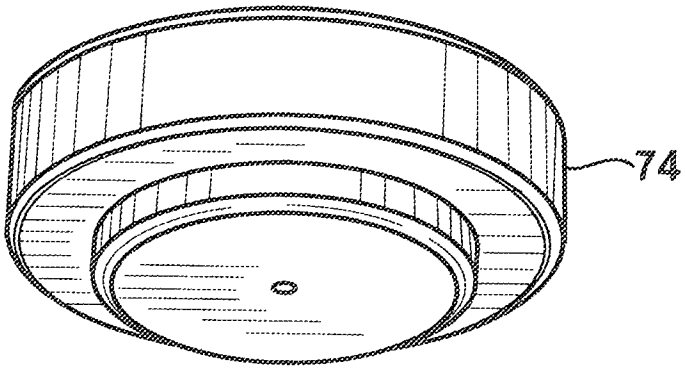
Fig. 7 (Prior art)
FIG. 7 is an isometric view of a prior art spinneret plate.
Figure 11:
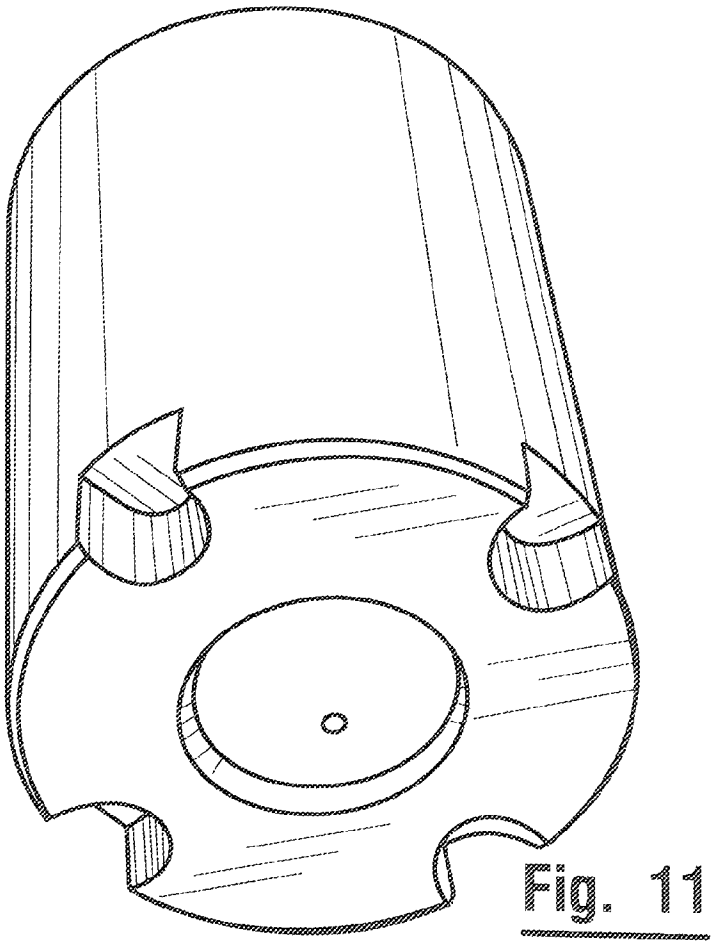
Fig. 11 (Prior art)
FIG. 11 is an isometric view showing a prior art spin pack assembly including the fiber exit opening closer to the body exit.
Figure 10:
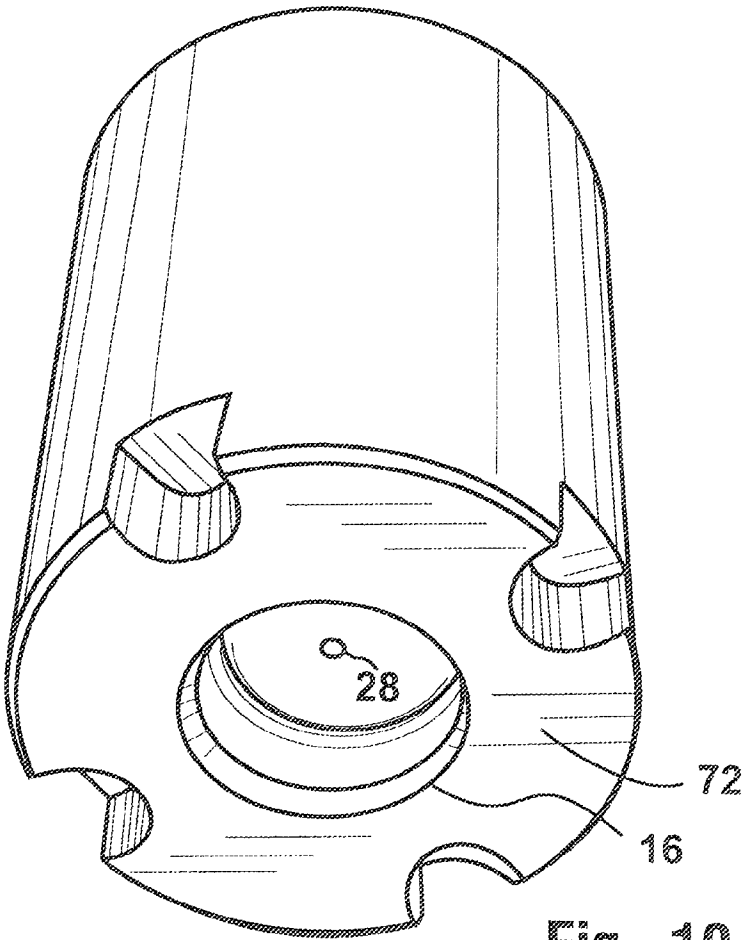
FIG. 10 is an isometric view of the cylindrical body of the exemplary spin pack assembly showing the recessed fiber exit of an exemplary embodiment.

FIG. 10 shows the axial end of the spin pack assembly of an exemplary embodiment with the exit 28 of the spinneret plate axially recessed inwardly relative to the opening in the body. FIG. 11 contrasts the prior art approach in which the exit from the spinneret plate was generally at the same level or only recessed slightly such as in the range of 2 mm from the body annular surface. Similarly FIG. 6 shows an isometric view of the spacer 20 which serves to recess the opening in the spinneret plate and the exit therein, from the body opening. This is in contrast to the prior art spinneret plate 74 shown in FIG. 7.

As can be appreciated from a comparison to the exemplary embodiment to the prior art, the exemplary embodiment slows the cooling of the fiber through the use of recessed fiber exit and the surround body recess. This approach substantially improves the properties of the fiber which is produced using the spin pack assembly of the exemplary embodiment. Of course these structures are exemplary and in other embodiments other approaches may be used.

In an exemplary embodiment the polymer material to be melt spun into elastic fibers is fed to an extruder to melt the polymer. The melted polymer can optionally be fed from the extruder and mixed with a crosslinking agent and fed to a manifold. If no crosslinking agent is used, the polymer melt is fed directly to a manifold. The polymer flows from the manifold to a melt pump. The melt pump feds the polymer to the spin pack assembly. The polymer melt enters the spin pack assembly through the inlet 46. The polymer melt proceeds from the entrance 46 through the screen 38. The screen 38 removes any foreign matter and unmelted polymer. The polymer melt material proceeds through the screen 38 to the breaker plate 34. The polymer passes through the apertures in the breaker plate to the spinneret plate 24. From the spinneret plate 24 a fiber is formed at the exit 28 as the polymer melt is passed through the fiber opening 26 in the spinneret plate 24. The fiber is cooled and coated with finishing oil and wound into bobbins.

The most desirable elastic fiber to use in this exemplary embodiment is a lightly crosslinked thermoplastic polyurethane (TPU). The preferred TPU polymer will be described below.

The preferred TPU embodiment is a polyether TPU. The TPU is made from a blend of hydroxyl terminated intermediates reacted with a polyisocyanate and a hydroxyl terminated chain extender.

It has been found that when using a polyether TPU polymer to make melt spun fiber, a blend of hydroxyl terminated intermediates having different number average molecular weights gives superior processing features for melt spinning fibers. It has been found that if the blend of hydroxyl terminated intermediates is such that the higher molecular weight intermediate blended with the lower molecular weight intermediate gives a weighted average molecular weight of at least 1200 Daltons. Preferably, from 1200 to 4000 Daltons, and more preferably from 1500 to 2500 Daltons, the TPU can be melt spun for extended periods of time without excessive pressure building up in the exemplary spin pack assembly. This avoids excessive pressure which results in fiber breakage, thus requiring the melt spinning operation to be halted until the spin pack can be cleaned.

To produce the melt-spun fibers according to an exemplary embodiment, it is required to have a TPU made from a blend of at least two hydroxyl terminated intermediates and a crosslinking agent. The blend of intermediates has a first polyether intermediate as the major component and with a higher $M_n$ than the second intermediate. The second intermediate is selected from the group consisting of polyether, polyester, polycarbonate, polycaprolactone, and mixtures thereof; and the second intermediate has a lower $M_n$ than the first intermediate. Preferably, the second intermediate is also a polyether. For simplicity, the embodiment will be described herein in terms of polyether TPU having a blend of polyether intermediates. It should be recognized that the second intermediate can be other than polyether intermediates, but must be present in lower amounts and have a lower $M_n$ than the first polyether intermediate.

The polyether TPU used can be made by reacting a blend of at least two polyether hydroxyl terminated intermediates with a polyisocyanate and a chain extender.

Hydroxyl terminated polyether intermediates are polyether polyols derived from a diol or polyol having a total of from 2 to 15 carbon atoms, preferably an alkyl diol or glycol which is reacted with an ether comprising an alkylene oxide having from 2 to 6 carbon atoms, typically ethylene oxide or propylene oxide or mixtures thereof. For example, hydroxyl functional polyether can be produced by first reacting propylene glycol with propylene oxide followed by subsequent reaction with ethylene oxide. Primary hydroxyl groups resulting from ethylene oxide are more reactive than secondary hydroxyl groups and thus are preferred. Useful commercial polyether polyols include poly(ethylene glycol) comprising ethylene oxide reacted with ethylene glycol, poly (propylene glycol) comprising propylene oxide reacted with propylene glycol, poly(tetramethyl glycol) comprising water reacted with tetrahydrofuran (PTMEG). Polytetramethylene ether glycol (PTMEG) is the preferred polyether intermediate. Polyether polyols further include polyamide adducts of an alkylene oxide and can include, for example, ethylenediamine adduct comprising the reaction product of ethylenediamine and propylene oxide, diethylenetriamine adduct comprising the reaction product of diethylenetriamine with propylene oxide, and similar polyamide type polyether polyols. Copolyethers can also be utilized in exemplary embodiments. Typical copolyethers include the reaction product of THF and ethylene oxide or THF and propylene oxide. These are available from BASF as Poly THF B, a block copolymer, and poly THF R, a random copolymer. The various polyether intermediates generally have a number average molecular weight (Mn), as determined by assay of the terminal functional groups which is an average molecular weight greater than 700, such as from about 700 to about 10,000, desirably from about 1000 to about 5,000, and preferably from about 1000 to about 2500 Daltons.

Exemplary embodiments use a blend of two or more polyether intermediates, with one polyether being a higher molecular weight than the other polyether. The lower molecular weight polyether will have a molecular weight Mn of from 700 to 1500 Daltons while the higher molecular weight polyether will have a Mn from about 1500 to about 4000 Daltons, preferably from about 1800 to about 2500 Daltons. The blend should have a weighted average molecular weight of greater than 1200 Daltons, preferably greater than 1500 Daltons. For example, a 1000 gram sample of a blend of 70% by weight of a 2000 $M_n$ polyether and 30% by weight of a 1000 $M_n$ polyether would have a weighted average $M_n$ of 1538 Daltons of the two components in the 1000 grams mixture. The 2000 $M_n$ polyether component would have 0.35 moles (1000×0.7/2000). The 1000 $M_n$ polyether component would have 0.3 moles (1000×0.3/1000). The total moles would be 0.65 (0.35+0.3) moles in the 1000 gram sample and have a weighted average $M_n$ of (1000/0.65) or 1538 $M_n$.

The weight ratio in the blend of the first polyether hydroxyl terminated intermediate to the second hydroxyl terminated intermediate is from about 60:40 to about 90:10, and preferably from about 70:30 to 90:10. The amount of the first polyether intermediate is greater than the amount of the second intermediate.

The second necessary ingredient to make the TPU polymer of this embodiment is a polyisocyanate.

The polyisocyanates generally have the formula $R(NCO)_n$ where n is generally from 2 to 4 with 2 being highly preferred inasmuch as the composition is a thermoplastic. Thus, polyisocyanates having a functionality of 3 or 4 are utilized in very small amounts, for example less than 5% and desirably less than 2% by weight based upon the total weight of all polyisocyanates, inasmuch as they cause crosslinking. R can be aromatic, cycloaliphatic, and aliphatic, or combinations thereof generally having a total of from 2 to about 20 carbon atoms. Examples of suitable aromatic diisocyanates include diphenyl methane-4,4'-diisocyanate (MDI), $H_{12}$ MDI, m-xylylene diisocyanate (XDI), m-tetramethyl xylylene diisocyanate (TMXDI), phenylene-1,4-diisocyanate (PPDI), 1,5-naphthalene diisocyanate (NDI), and diphenylmethane-3,3'-dimethoxy-4,4'-diisocyanate (TODD. Examples of suitable aliphatic diisocyanates include isophorone diisocyanate (IPDI), 1,4-cyclohexyl diisocyanate (CHDI), hexamethylene diisocyanate (HDI), 1,6-diisocyanato-2,2,4,4-tetramethyl hexane (TMDI), 1,10-decane diisocyanate, and trans-dicyclohexylmethane diisocyanate (HMDI). A highly preferred diisocyanate is MDI containing less than about 3% by weight of ortho-para (2,4) isomer. A blend of two or more polyisocyanates may be used.

The third necessary ingredient to make the TPU polymer is the chain extender. Suitable chain extenders are lower aliphatic or short chain glycols having from about 2 to about 10 carbon atoms and include for instance ethylene glycol, diethylene glycol, propylene glycol, dipropylene glycol, tripropylene glycol, triethylene glycol, Cis-trans-isomers of cyclohexyl dimethylol, neopentyl glycol, 1,4-butanediol, 1,6-hexandiol, 1,3-butanediol, and 1,5-pentanediol. Aromatic glycols can also be used as the chain extender and are the preferred choice for high heat applications. Benzene glycol (HQEE) and xylenene glycols are suitable chain extenders for use in making the TPU of this invention. Xylenene glycol is a mixture of 1,4-di(hydroxymethyl)benzene and 1,2-di(hydroxymethyl)benzene. Benzene glycol is the preferred aromatic chain extender and specifically includes hydroquinone, i.e., bis(beta-hydroxyethyl)ether also known as 1,4-di(2-hydroxyethoxy)benzene; resorcinol, i.e., bis(beta-hydroxyethyl)ether also known as 1,3-di(2-hydroxyethyl)benzene; catechol, i.e., bis(beta-hydroxyethyl)ether also known as 1,2-di(2-hydroxyethoxy)benzene; and combinations thereof. For high heat resistant fibers, benzene glycol (HQEE) is the desired chain extender. Excellent results are obtained by using HQEE together with an isomer of HQEE.

It is preferred to use a co-chain extender together with the chain extender described above. The co-chain extender can be one of the materials described above as a chain extender. The co-chain extender is preferably selected from a material capable of reducing the crystallization rate of the TPU and eliminating high temperature melting peaks of the TPU. Branched compounds, such as dipropylene glycol and neopentyl glycol are excellent co-chain extenders. Also, for high heat applications, an isomer of HQEE, such as hydroxylethyl resorcinol (HER), is a very effective co-chain extender. When a co-chain extender is used, the level used is from about 2 to about 50 mole percent, preferably 10 to 30 mole percent, of the total moles of the chain extender and the co-chain extender.

A blend of two or more chain extenders can be used with a blend of two or more co-chain extenders, if desired. However, for simplicity, usually one chain extender is used with one co-chain extender.

The above three necessary ingredients (blend of different Mn polyether intermediates, polyisocyanate, and chain extender) are preferably reacted in the presence of a catalyst.

Generally, any conventional catalyst can be utilized to react the diisocyanate with the polyether intermediates or the chain extender and the same is well known in the art and in the literature. Examples of suitable catalysts include the various alkyl ethers or alkyl thiol ethers of bismuth or tin wherein the alkyl portion has from 1 to about 20 carbon atoms with specific examples including bismuth octoate, bismuth laurate, and the like. Preferred catalysts include the various tin catalysts such as stannous octoate, dibutyltin dioctoate, dibutyltin dilaurate, and the like. The amount of such catalyst is generally small such as from about 20 to about 200 parts per million based upon the total weight of the polyurethane forming monomers.

The polyether TPU polymers of this invention can be made by any of the conventional polymerization methods well known in the art and literature.

Thermoplastic polyurethanes of exemplary embodiments are preferably made via a "one shot" process wherein all the components are added together simultaneously or substantially simultaneously to a heated extruder and reacted to form the polyurethane. The equivalent ratio of the diisocyanate to the total equivalents of the hydroxyl terminated polyether intermediates and the diol chain extender is generally from about 0.95 to about 1.10, desirably from about 0.97 to about 1.03, and preferably from about 0.97 to about 1.00. It is preferred that the equivalent ratio is less than 1.0 such that the TPU has terminal hydroxyl groups to enhance the reaction with the crosslinking agent during the fiber spinning process. The Shore A hardness of the TPU formed should be from 65 A to 95 A, and preferably from about 75 A to about 85 A, to achieve the most desirable melt spun fibers. Reaction temperatures utilizing urethane catalyst are generally from about 175° C. to about 245° C. and preferably from about 180° C. to about 220° C. The molecular weight (Mw) of the thermoplastic polyurethane is generally from about 25,000 to about 300,000 and desirably from about 50,000 to about 200,000 and preferably about 75,000 to about 150,000 as measured by GPC relative to polystyrene standards. The preferred $M_w$ is lower than the prior art recommends for the TPU fiber, but the lower $M_w$ allows for better mixing of the TPU with the crosslinking agent to give excellent fiber spinning.

The thermoplastic polyurethanes can also be prepared utilizing a pre-polymer process. In the pre-polymer route, the hydroxyl terminated polyether intermediates are reacted with generally an equivalent excess of one or more polyisocyanates to form a pre-polymer solution having free or unreacted polyisocyanate therein. Reaction is generally carried out at temperatures of from about 80° C. to about 220° C. and preferably from about 150° C. to about 200° C. in the presence of a suitable urethane catalyst. Subsequently, a selective type of chain extender as noted above is added in an equivalent amount generally equal to the isocyanate end groups as well as to any free or unreacted diisocyanate compounds. The overall equivalent ratio of the total diisocyanate to the total equivalent of the hydroxyl terminated polyethers and the chain extender is thus from about 0.95 to about 1.10, desirably from about 0.98 to about 1.05 and preferably from about 0.99 to about 1.03. The equivalent ratio of the hydroxyl terminated polyethers to the chain extender is adjusted to give 65 A to 95 A, preferably 75 A to 85 A Shore hardness. The chain extension reaction temperature is generally from about 180° C. to about 250° C. with from about 200° C. to about 240° C. being preferred. Typically, the pre-polymer route can be carried out in any conventional device with an extruder being preferred. Thus, the polyether intermediates are reacted with an equivalent excess of a diisocyanate in a first portion of the extruder to form a pre-polymer solution and subsequently the chain extender is added at a downstream portion and reacted with the pre-polymer solution. Any conventional extruder can be utilized, with extruders equipped with barrier screws having a length to diameter ratio of at least 20 and preferably at least 25. The prepolymer method can reduce high temperature melting peaks of the TPU and eliminate the need for a co-chain extender as described in the one-shot process above.

Useful additives can be utilized in suitable amounts and include opacifying pigments, colorants, mineral fillers, stabilizers, lubricants, UV absorbers, processing aids, and other additives as desired. Useful opacifying pigments include titanium dioxide, zinc oxide, and titanate yellow, while useful tinting pigments include carbon black, yellow oxides, brown oxides, raw and burnt sienna or umber, chromium oxide green, cadmium pigments, chromium pigments, and other mixed metal oxide and organic pigments. Useful fillers include diatomaceous earth (superfloss) clay, silica, talc, mica, wallostonite, barium sulfate, and calcium carbonate. If desired, useful stabilizers such as antioxidants can be used and include phenolic antioxidants, while useful photostabilizers include organic phosphates, and organotin thiolates (mercaptides). Useful lubricants include metal stearates, paraffin oils and amide waxes. Useful UV absorbers include 2-(2'-hydroxyphenol) benzotriazoles and 2-hydroxybenzophenones.

Plasticizer additives can also be utilized advantageously to reduce hardness without affecting properties.

During the melt spinning process, the TPU polymer described above is lightly crosslinked with a crosslinking agent. The crosslinking agent is a pre-polymer of a hydroxyl terminated intermediate that is a polyether, polyester, polycarbonate, polycaprolactone, or mixture thereof reacted with a polyisocyanate. A polyester or polyether is the preferred hydroxyl terminated intermediate to make the crosslinking agent. The crosslinking agent, pre-polymer, will have an isocyanate functionality of greater than about 1.0, preferably from about 1.0 to about 3.0, and more preferably from about 1.8 to about 2.2. It is particularly preferred if both ends of hydroxyl terminated intermediate is capped with an isocyanate, thus having an isocyanate functionality of 2.0.

The polyisocyanate used to make the crosslinking agent are the same as described above in making the TPU polymer. A diisocyanate, such as MDI, is the preferred diisocyanate.

The hydroxyl terminated polyester intermediate used to make the crosslinking agent is generally a linear or branched polyester having a number average molecular weight (Mn) of from about 500 to about 10,000, desirably from about 700 to about 5,000, and preferably from about 700 to about 4,000, an acid number generally less than 1.3 and preferably less than 0.8. The molecular weight is determined by assay of the terminal functional groups and is related to the number average molecular weight. The polymers are produced by (1) an esterification reaction of one or more glycols with one or more dicarboxylic acids or anhydrides or (2) by transesterification reaction, i.e., the reaction of one or more glycols with esters of dicarboxylic acids. Mole ratios generally in excess of more than one mole of glycol to acid are preferred so as to obtain linear chains having a preponderance of terminal hydroxyl groups. Suitable polyester intermediates also include various lactones such as polycaprolactone typically made from ϵ-caprolactone and a bifunctional initiator such as diethylene glycol. The dicarboxylic acids of the desired polyester can be aliphatic, cycloaliphatic, aromatic, or combinations thereof. Suitable dicarboxylic acids which may be used alone or in mixtures generally have a total of from 4 to 15 carbon atoms and include: succinic, glutaric, adipic, pimelic, suberic, azelaic, sebacic, dodecanedioic, isophthalic, terephthalic, cyclohexane dicarboxylic, and the like. Anhydrides of the above dicarboxylic acids such as phthalic anhydride, tetrahydrophthalic anhydride, or the like, can also be used. Adipic acid is the preferred acid. The glycols which are reacted to form a desirable polyester intermediate can be aliphatic, aromatic, or combinations thereof, and have a total of from 2 to 12 carbon atoms, and include ethylene glycol, neopentyl glycol, dipropylene glycol, 1,2-propanediol, 1,3-propanediol, 1,3-butanediol, 1,4-butanediol, 1,5-pentanediol, 1,6-hexanediol, 2,2-dimethyl-1,3-propanediol, 1,4-cyclohexanedimethanol, decamethylene glycol, dodecamethylene glycol, and the like. 1,4-butanediol and mixtures with neopentyl glycol are the preferred glycol.

U.S. Pat. No. 4,131,731 is hereby incorporated by reference for its disclosure of hydroxyl terminated polycarbonates and their preparation. Such polycarbonates are linear and have terminal hydroxyl groups with essential exclusion of other terminal groups. The essential reactants are glycols and carbonates. Suitable glycols are selected from cycloaliphatic and aliphatic diols containing 4 to 40, and preferably 4 to 12 carbon atoms, and from polyoxyalkylene glycols containing 2 to 20 alkoxy groups per molecular with each alkoxy group containing 2 to 4 carbon atoms. Diols suitable for use in exemplary embodiments include aliphatic diols containing 4 to 12 carbon atoms such as butanediol-1,4, pentanediol-1,4, neopentyl glycol, hexanediol-1,6,2,2,4-trimethylhexanediol-1,6, decanediol-1,10, hydrogenated dilinoleylglycol, hydrogenated dioleylglycol; and cycloaliphatic diols such as cyclohexanediol-1,3, dimethylolcyclohexane-1,4, cyclohexanediol-1,4, dimethylolcyclohexane-1,3,1,4-endomethylene-2-hydroxy-5-hydroxymethyl cyclohexane, and polyalkylene glycols. The diols used in the reaction may be a single diol or a mixture of diols depending on the properties desired in the finished product.

Polycarbonate intermediates which are hydroxyl terminated are generally those known in the art and in the literature. Suitable carbonates are selected from alkylene carbonates composed of a 5 to 7 membered ring having the following general formula:

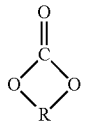

where R is a saturated divalent radical containing 2 to 6 linear carbon atoms. Suitable carbonates for use herein include ethylene carbonate, trimethylene carbonate, tetramethylene carbonate, 1,2-propylene carbonate, 1,2-butylene carbonate, 2,3-butylene carbonate, 1,2-ethylene carbonate, 1,3-pentylene carbonate, 1,4-pentylene carbonate, 2,3-pentylene carbonate, and 2,4-pentylene carbonate.

Also, suitable herein are dialkylcarbonates, cycloaliphatic carbonates, and diarylcarbonates. The dialkylcarbonates can contain 2 to 5 carbon atoms in each alkyl group and specific examples thereof are diethylcarbonate and dipropylcarbonate. Cycloaliphatic carbonates, especially dicycloaliphatic carbonates, can contain 4 to 7 carbon atoms in each cyclic structure, and there can be one or two of such structures. When one group is cycloaliphatic, the other can be either alkyl or aryl. On the other hand, if one group is aryl, the other can be alkyl or cycloaliphatic. Preferred examples of diarylcarbonates, which can contain 6 to 20 carbon atoms in each aryl group, are diphenylcarbonate, ditolylcarbonate, and dinaphthylcarbonate.

The reaction is carried out by reacting a glycol with a carbonate, preferably an alkylene carbonate in the molar range of 10:1 to 1:10, but preferably 3:1 to 1:3 at a temperature of 100° C. to 300° C. and at a pressure in the range of 0.1 to 300 mm of mercury in the presence or absence of an ester interchange catalyst, while removing low boiling glycols by distillation.

More specifically, the hydroxyl terminated polycarbonates are prepared in two stages. In the first stage, a glycol is reacted with an alkylene carbonate to form a low molecular weight hydroxyl terminated polycarbonate. The lower boiling point glycol is removed by distillation at 100° C. to 300° C., preferably at 150° C. to 250° C., under a reduced pressure of 10 to 30 mm Hg, preferably 50 to 200 mm Hg. A fractionating column is used to separate the by-product glycol from the reaction mixture. The by-product glycol is taken off the top of the column and the unreacted alkylene carbonate and glycol reactant are returned to the reaction vessel as reflux. A current of inert gas or an inert solvent can be used to facilitate removal of by-product glycol as it is formed. When amount of by-product glycol obtained indicates that degree of polymerization of the hydroxyl terminated polycarbonate is in the range of 2 to 10, the pressure is gradually reduced to 0.1 to 10 mm Hg and the unreacted glycol and alkylene carbonate are removed. This marks the beginning of the second stage of reaction during which the low molecular weight hydroxyl terminated polycarbonate is condensed by distilling off glycol as it is formed at 100° C. to 300° C., preferably 150° C. to 250° C. and at a pressure of 0.1 to 10 mm Hg until the desired molecular weight of the hydroxyl terminated polycarbonate is attained. Molecular weight (Mn) of the hydroxyl terminated polycarbonates can vary from about 500 to about 10,000 but in a preferred embodiment, it will be in the range of 500 to 2500.

If a polyether crosslinking agent is desired, it is made from a hydroxyl terminated polyether intermediate as described above for making the TPU polymer and is reacted with a polyisocyanate to form a pre-polymer.

The crosslinking agents have a number average molecular weight (Mn) of from about 1,000 to about 10,000, preferably from about 1,200 to about 4,000 and more preferably from about 1,500 to about 2,800. Crosslinking agents with a $M_n$ above about 1500 give better set properties.

The weight percent of crosslinking agent used with the TPU polymer is from about 5.0% to about 20%, preferably about 8.0% to about 15%, and more preferably from about 10% to about 13% The percentage of crosslinking agent used is weight percent based upon the total weight of TPU polymer and crosslinking agent.

The exemplary melt spinning process to make TPU fibers involves feeding a preformed TPU polymer, usually which is melted in the extruder and the crosslinking agent is added continuously downstream near the point where the TPU melt exits the extruder or after the TPU melt exits the extruder. The crosslinking agent can be added to the extruder before the melt exits the extruder or after the melt exits the extruder. If added after the melt exits the extruder, the crosslinking agent needs to be mixed with the TPU melt using static or dynamic mixers to assure proper mixing of the crosslinking agent into the TPU polymer melt. After exiting the extruder and mixer, the melted TPU polymer with crosslinking agent flows into a manifold. The manifold divides the melt stream into different streams, where each stream is fed to a plurality of spin pack assemblies. Usually, there is a melt pump for each different stream flowing from the manifold, with each melt pump feeding several spin pack assemblies. Each spin pack assembly may be of the type previously described or may have alternative structure.

The TPU melt material is forced by elevated pressure through the spin pack assembly and exits the spinneret plate in the form of a fiber. The size of the hole in the spinneret plate is based on the desired size (denier) of the fiber. The fiber is drawn or stretched as it leaves the spin pack assembly and is cooled before winding onto bobbins. The fibers are stretched by winding the bobbins at a higher speed than that of fiber exiting the spin pack assembly. For the melt spun TPU fibers, the bobbins are usually wound at a rate of 4 to 6 times the speed of the fiber exiting the spin pack assembly, but can be wound slower or faster depending on the particular equipment. Typical bobbin winding speeds can vary from 100 to 3000 meters per minute, but more typical speeds are 300 to 1200 meters per minute for TPU melt spun fibers. Finish oils, such as silicone oils, are usually added to the surface of the fibers after cooling and just prior to being wound into bobbins.

An important aspect of the exemplary melt spinning process is the mixing of the TPU polymer melt with the crosslinking agent. Proper uniform mixing is important to achieve uniform fiber properties and to achieve long run times without experiencing fiber breakage. The mixing of the TPU melt and crosslinking agent should be a method which achieves plug-flow, i.e., first in first out. The proper mixing can be achieved with a dynamic mixer or a static mixer. Static mixers are more difficult to clean; therefore, a dynamic mixer is preferred. A dynamic mixer which has a feed screw and mixing pins is the preferred mixer. U.S. Pat. No. 6,709,147, which is incorporated herein by reference, describes such a mixer and has mixing pins which can rotate. The mixing pins can also be in a fixed position, such as attached to the barrel of the mixer and extending toward the centerline of the feed screw. The mixing feed screw can be attached by threads to the end of the extruder screw and the housing of the mixer can be bolted to the extruder machine. The feed screw of the dynamic mixer should be a design which moves the polymer melt in a progressive manner with very little back mixing to achieve plug-flow of the melt. The L/D of the mixing screw should be from over 3 to less than 30, preferably from about 7 to about 20, and more preferably from about 10 to about 12.

The temperature in the mixing zone where the TPU polymer melt is mixed with the crosslinking agent is from about 200° C. to about 240° C., preferably from about 210° C. to about 225° C. These temperatures are necessary to get the reaction while not degrading the polymer.

The TPU formed is reacted with the crosslinking agent during the fiber spinning process to give a molecular weight (Mw) of the TPU in fiber form of from about 200,000 to about 800,000, preferably from about 250,000 to about 500,000, more preferably from about 300,000 to about 450,000. The reaction in the fiber spinning process between the TPU and the crosslinking agent at the point where the TPU exits the spin pack assembly should be above 20%, preferably from about 30% to about 60%, and more preferably from about 40% to about 50%. Typical prior art TPU melt spinning reaction between the TPU polymer and the crosslinking agent is less than 20% and usually about 10-15% reaction. The reaction is determined by the disappearance of the NCO groups. The higher % reaction of the exemplary embodiment improves melt strength thus allowing a higher spinning temperature which improves the spinnability of the TPU. The fibers are normally aged in an oven on the bobbins to fully complete the reaction and thus all of the NCO groups disappear in the fiber as used in garments.

The spinning temperature (the temperature of the polymer melt in the spin pack assembly) should be higher than the melting point of the polymer, and preferably from about 10° C. to about 20° C. above the melting point of the polymer. The higher the spinning temperature one can use, generally the better the spinning. However, if the spinning temperature is too high, the polymer can degrade. Therefore, from about 10° C. to about 20° C. above the melting point of the TPU polymer, is the optimum for the exemplary embodiment for achieving a balance of good spinning without degradation of the polymer. If the spinning temperature is too low, polymer can solidify in the spinneret and cause fiber breakage. The spinning temperature for the fibers produced in exemplary embodiments is greater than 200° C. and preferably from about 205° C. to about 220° C.

An important aspect of making melt spun TPU fibers is the time one can run the process continuously without stopping. The necessity to stop the process is usually a result of fiber breaking. Fiber breaking occurs when the pressure at the inlet of the spin pack assembly increases to an unacceptable level. When the pressure reaches about 140 to 200 Kg force per square cm., fiber breakage will usually occur. Pressure buildup can occur for several reasons such as improper mixing leading to formation of products due to self reaction of the crosslinking agent causing partial blockage of the small exit hole in the spinneret for the fiber. The exemplary embodiment allows for much longer run times before exceeding harmful pressure build-up resulting in fiber breakage.

The following examples show advantages of the exemplary spin pack assembly relative to a conventional spin pack assembly. The spin pack assembly of the exemplary embodiment was evaluated against the prior art spin pack assembly. The evaluation was conducted by melt spinning a thermoplastic polyurethane (TPU) polymer. The TPU polymer used was made by reacting a polyether hydroxyl terminated intermediate (a blend of 2000 Mn PTMEG and 1000 Mn PTMEG), a glycol aromatic chain extender [a blend of benzene glycol (HQEE) and hydroxylethyl resorcinol (HER)], and a diisocyanate (MDI). The three components (polyether intermediate, glycol chain extender, and diisocyanate) were reacted in a twin screw extruder using the one-shot process at 200° C. The TPU polymer was palletized and used in Examples 1 and 2 below to spin fibers. The exit at which the fiber was produced by the spin pack assembly was axially recessed about 15.5 mm from the opening of the body of the spin pack assembly.

Example 1

Comparative

The TPU polymer described above was used to melt spin 40 denier fibers. The TPU polymer pellets were melted in an extruder and the polymer melt was mixed with a polyester prepolymer crosslinking agent (Hyperlast® 5255) in a dynamic mixer. The TPU melt containing the crosslinking agent was then fed to the prior art spin pack assembly and 40 denier melt spun fibers were produced. A silicon finish oil was applied to the fibers and they were wound onto bobbins at a speed of 600 meters per minute. After continuous running for 60 hours, the pressure in the spin pack showed an increase over the beginning pressure of 81.2% and fibers started to break. The run was terminated because of fiber breakage.

Example 2

In this Example, the spin pack assembly of the described exemplary embodiment was used to make 40 denier fibers. The same TPU polymer and the same crosslinking agent were used and the same melt spinning process was used as in Example 1. The only difference was that the spin pack assembly of the exemplary embodiment was used in place of the prior art spin pack assembly. After continuous running for 120 hours, the pressure in the spin pack showed an increase of only 9.5% over the initial pressure. The run was terminated after 120 hours because all material was consumed.

Physical property tests on the fibers made by Comparative Example 1 and Example 2 showed that the fibers made by Example 2 had a lower 100% modulus indicating that the recessed exit of the fibers from the spin pack assembly allowed the fibers to cool slower, thus improving their properties for kitting and weaving.

The Examples show that the spin pack assembly of the exemplary embodiment has major advantages in making elastic fibers, such as TPU. By dramatically increasing the run time before experiencing fiber breakage because of excess pressure build-up, the melt spinning process is more economical and there is less waste from scrap material generated as a result of fiber breakage. The properties of the TPU fibers are also improved resulting in better knitting and weaving the fibers into garments.

Melt spun TPU fibers can be made in a variety of denier. Denier is a term in the art designating the fiber size. Denier is the weight in grams of 9000 meters of fiber length. Typical melt spun TPU fibers are made in a denier size less than 240, more typical from 10 to less than 240 denier size, with 20 and 40 denier being a popular size.

The elastic TPU fibers are used to combine by knitting or weaving with other fibers such as natural and synthetic fibers to make various articles of clothing. The TPU fibers can be dyed various colors.

The melt spun elastic TPU fibers of exemplary embodiments are normally combined by knitting or weaving with other fibers, such as cotton, nylon or polyester to make various end use articles, including clothing garments. The weight % of the melt spun elastic fibers in the end use application can vary depending on the desired elasticity. For example, woven fabrics have from 1-8 wt. %, underwear from 2-5 wt. %, bathing suits and sportswear from 8-30 wt. %, foundation garments from 10-45 wt. %, and medical hose from 35-60 wt. % of the elastic melt spun fibers with the remaining amount being another type of non-elastic fiber.

The exemplary configuration of the exemplary spin pack assembly provides for the fiber produced to cool more slowly which has been found to decrease the 100% modulus. This decrease in modulus allows the fiber to perform better in knitting operations, such as circular knitting.

The exemplary spin pack assembly produces improved material flow properties for the polymer, which allows for greater run time before experiencing problems, such as fiber breakage.

While in accordance with the Patent Statutes, the best mode and preferred embodiment has been set forth, the scope of the invention is not limited thereto, but rather by the scope of the attached claims.

What is claimed is:

1. A method of melt spinning an elastomeric fiber comprising the steps of:

(I) Supplying a fluid thermoplastic material to a spin pack assembly;

wherein the spin pack assembly is operative to receive said fluid thermoplastic material wherein said material is generally free of lumps therein, and to output a single fiber of the material, wherein the material reacts to form lumps therein generally within a reaction time after the material is received within the spin pack assembly, the assembly including:

a cylindrical body, the cylindrical body extending along a central axis, and wherein the body includes a first axial end and a second axial portion axially disposed from the first axial end;

an inlet adjacent the second axial portion, wherein the inlet is operative to receive the material at elevated pressure;

a spinneret plate adjacent the first axial end, wherein the spinneret plate includes one axially positioned fiber opening, wherein the opening is operative to output the single fiber;

a cavity area within the body, wherein the cavity area is fluidly intermediate of the inlet and the fiber opening;

a breaker plate, wherein the breaker plate extends in the cavity area, and wherein the breaker plate includes a plurality of apertures therethrough, wherein each of the apertures is operative to provide material flow therethrough, and wherein said breaker plate includes one axially aligned central aperture, and wherein the plurality of apertures are arranged in a plurality of concentric circular patterns about the axis, and wherein each of plurality of apertures in a first concentric circular pattern closest to the axis, is disposed radially from the central aperture a first radial distance, and wherein the plurality of apertures in a second concentric circular pattern disposed radially outward and immediately adjacent the apertures in the first concentric circular pattern, are disposed radially outward from the apertures in the first concentric circular pattern a second radial distance, wherein the first radial distance is greater than the second radial distance and wherein the apertures are positioned to provide a first-in/first-out material flow through the cavity area such that a residence time that material is within the cavity area is less than the reaction time generally throughout the entire cavity area.

2. The method according to claim 1 wherein the plurality of apertures are positioned to provide greater material flow with increasing radial distance from the axis in the cavity area.

3. The method according to claim 2 wherein the plurality of apertures each have greater cross-sectional area with increasing radial distance from the axis.

4. The method according to claim 1 wherein all the apertures included in each concentric circular pattern have generally the same cross-sectional area.

5. The method according to claim 1 wherein the breaker plate includes a third concentric circular pattern of apertures disposed radially outward from and immediately adjacent to the second concentric circular pattern of apertures, and wherein the plurality of apertures in the third concentric circular pattern of apertures are disposed radially outward from the apertures in the second concentric circular pattern a third radial distance, wherein the first radial distance is greater than the third radial distance.

6. The method according to claim 5 wherein the cavity area is bounded adjacent the first axial end by a generally planar first annular surface.

7. The method according to claim 6 wherein the cavity area is bounded adjacent the second axial portion by a generally planar second annular surface.

8. The method according to claim 7 wherein the body includes body opening adjacent the first axial end, wherein the body opening is generally aligned with the axis, and wherein the fiber opening in the spinneret plate includes an exit at which the fiber is output, and wherein the exit is disposed axially inward within the body relative to the body opening at least 5 mm.

9. The method according to claim 8 and further comprising a screen, wherein the screen extends in the cavity area, and wherein the screen is positioned intermediate of the inlet and the breaker plate.

10. The method according to claim 9 wherein the spin pack assembly further includes:

a transport channel piece, and a compression nut, wherein the transport channel piece includes a annular portion and an axially centered cylindrical projection portion, wherein the inlet extends through the annular portion and the cylindrical projection portion, and wherein the compression nut includes an external annular threaded portion and an axially centered access opening, wherein the annular threaded portion is operatively releasibly engaged with the body, and wherein the cylindrical projection portion extends in the access opening.

11. The method according to claim 10 wherein the material comprises thermoplastic polyurethane (TPU) polymer.

12. The method according to claim 11 wherein the exit is disposed axially inward within the body relative to the body opening about 15.5 mm.

13. The method according to claim 12 wherein the TPU within the cavity area is at least 200° C.

14. The method according to claim 1 wherein the central aperture has a smaller cross-sectional area than apertures in at least one of the plurality of concentric circular patterns.

15. The method according to claim 1 wherein the plurality of apertures include apertures in at least three concentric circular patterns.

16. The method according to claim 1 wherein the body includes a body opening extending about the axis adjacent the first axial end, and wherein the fiber opening includes an exit, wherein the fiber is output at the exit, and wherein the exit is disposed axially inward relative to the body opening at least 5 mm.

17. The method according to claim 16 wherein the material comprises thermoplastic polyurethane (TPU) polymer, and wherein the exit is disposed axially inward relative to the body opening about 15.5 mm.

18. The method according to claim 1 wherein the body includes body opening disposed away from the inlet, and wherein the fiber outlet includes an exit, wherein the single fiber passes from the fiber outlet at the exit, and wherein the exit is recessed inwardly relative to the body opening at least 5 mm.

19. The method according to claim 1 wherein the body includes body opening disposed away from the inlet, and wherein the fiber outlet includes an exit, and wherein the single fiber passes from the fiber outlet at the exit, and wherein exit is recessed inwardly relative to the body opening about 15.5 mm.

* * * * *